US010349760B2

(12) United States Patent
Peake

(10) Patent No.: US 10,349,760 B2
(45) Date of Patent: Jul. 16, 2019

(54) ROTATING ART FRAME

(71) Applicant: Matthew J. Peake, Rockingham, VT (US)

(72) Inventor: Matthew J. Peake, Rockingham, VT (US)

( * ) Notice: Subject to any disclaimer, the term of this patent is extended or adjusted under 35 U.S.C. 154(b) by 0 days.

(21) Appl. No.: 15/725,449

(22) Filed: Oct. 5, 2017

(65) Prior Publication Data

US 2018/0116430 A1 May 3, 2018

Related U.S. Application Data

(63) Continuation-in-part of application No. 14/998,575, filed on Jan. 21, 2016.

(60) Provisional application No. 62/177,465, filed on Mar. 16, 2015.

(51) Int. Cl.
*A47G 1/16* (2006.01)

(52) U.S. Cl.
CPC ..... *A47G 1/166* (2013.01); *A47G 1/1606* (2013.01)

(58) Field of Classification Search
CPC ..... A47B 97/04; A47G 1/10; A47G 1/142; A47G 1/148; A47G 1/16; A47G 1/1613; A47G 1/166; A47G 1/168; A47G 2001/146; A47G 2001/148
See application file for complete search history.

(56) References Cited

U.S. PATENT DOCUMENTS 1,944,203 A * 1/1934 Wittig ..... A47G 1/168 248/494
2,509,424 A * 5/1950 Denton ..... A47G 1/1613 248/495
2,632,971 A * 3/1953 Cashman ..... A47G 1/0644 248/470
3,632,101 A * 1/1972 Ross ..... A47B 97/04 269/254 R
3,815,860 A * 6/1974 Bompart ..... A47B 97/04 248/464
3,880,395 A * 4/1975 Bompart ..... A47B 97/04 248/464
3,926,398 A * 12/1975 Vincent ..... A47B 97/08 248/448
4,309,017 A * 1/1982 Slemmons ..... A47G 1/162 248/495
4,473,207 A * 9/1984 Nascher ..... A47G 1/1646 248/488
4,684,099 A * 8/1987 Krapf ..... A47B 97/04 248/447.1
6,390,433 B1 * 5/2002 Kasa-Djukic ..... A47B 97/04 248/125.1

(Continued)

*Primary Examiner* — David R Dunn
*Assistant Examiner* — Christopher E Veraa
(74) *Attorney, Agent, or Firm* — Armis IP Law, LLC

(57) ABSTRACT

A rotating frame apparatus for a painting or other rectangular plane-based medium allows compact, rotational rendering of a display piece for viewing from multiple perspectives. A rotational hub adapts to wall or horizontal mounting, and includes adjustable, opposed pairs of arms that attach to stretcher bars or a perimeter of the rectangular piece. Fixation members secure the arms at the prescribed length while remaining hidden behind the display piece. The arms terminate in an attachment member that doubles as a handle and standoff to facilitate rotation and maintain a distance from a wall or mounting surface.

12 Claims, 7 Drawing Sheets

(56) References Cited

U.S. PATENT DOCUMENTS

| | | | | |
|---|---|---|---|---|
| 6,550,739 | B1 * | 4/2003 | Brindisi | A47G 1/1613 248/476 |
| 6,889,952 | B2 * | 5/2005 | Cook | A47B 97/08 248/448 |
| 7,377,476 | B2 * | 5/2008 | Almond | A47B 97/08 248/448 |
| 9,578,979 | B1 * | 2/2017 | Zeuch | A47G 1/164 |
| 2005/0156094 | A1 * | 7/2005 | Mussallem | A47G 1/168 248/475.1 |
| 2007/0040089 | A1 * | 2/2007 | Shiff | A47B 97/04 248/448 |
| 2009/0242723 | A1 * | 10/2009 | Starcher | A47B 97/08 248/460 |
| 2011/0138666 | A1 * | 6/2011 | Borde | A47G 1/166 40/747 |
| 2013/0097906 | A1 * | 4/2013 | Schultz | A47G 1/0605 40/747 |
| 2014/0326846 | A1 * | 11/2014 | Selwa | A47B 97/04 248/448 |
| 2015/0272352 | A1 * | 10/2015 | Chowdhury | A47G 1/166 40/747 |
| 2016/0270564 | A1 * | 9/2016 | Peake | A47G 1/166 |

* cited by examiner

ROTATING ART FRAME

RELATED APPLICATIONS

This application is a Continuation-In-Part (CIP) of U.S. patent application Ser. No. 14/998,575, filed Jan. 21, 2016, entitled "ROTATING ART FRAME," which claims the benefit under 35 U.S.C. § 119(e) of U.S. Provisional Patent Application No. 62/177,465, filed Mar. 16, 2015, incorporated herein by reference in entirety.

BACKGROUND

Display mediums for works of art are naturally sought for allowing purveyors to view and appreciate the work. Many artistic works are contained in a planar canvas, poster, or similar two-dimensional form adapted for display on a wall or table. Conventional approaches employ a frame, a rigid circumferential structure that lends perimeter support to the work. Alternatively, the work is contained on a rigid, intrinsically supporting sheet or board. Typically, such a work is hung or supported on a vertical or near-vertical structure such as a wall or easel.

SUMMARY

Conventional, fixed display mediums for a planar display piece such as a frame mounted canvas or similar planar rendering typically employ a predetermined mounting orientation. The predetermined mounting orientation is dictated by hangers and/or tethers attached to a rear side of the display medium. While some pictorial renderings may appear with an inherent orientation (i.e. human figures oriented upright), other works may be more abstract. Rotatable mountings and easels offer distinct advantages to the artist in the process of creation. They allow ease of access to all parts of the canvas; they let the artist view the emerging painting sideways or upside down for the purposes of assessing symmetry, compositional balance, etc.; and they allow the artist the ability to use gravity in any direction to manipulate the liquid media.

An ability to rotate and reorient the work is beneficial in both the creation (i.e. painting) phase and in the rendering (i.e. display) phase to allow the viewer/artist to appreciate different perspectives. An ability to do this without physically touching the work is beneficial, as an artist's hands may have residual paint deposits that could transfer to the work.

A rotating frame apparatus, as disclosed herein, for a painting or other rectangular plane-based medium allows compact, rotational rendering of a display piece for viewing from multiple perspectives. A rotational hub adapts to wall or horizontal mounting, and includes adjustable, opposed pairs of arms that attach to stretcher bars or a perimeter of the rectangular piece. Fixation members secure the arms at the prescribed length while remaining hidden behind the display piece. The arms terminate in an attachment member that doubles as a handle and standoff to facilitate rotation and maintain a distance from a wall or mounting surface.

Configurations herein are based, in part, on the observation that commercial artwork is typically delivered with a hanger wire strung between stretcher bars of the frame assembly. The hanger wire imposes a predetermined orientation to the hung display piece. To alternate between portrait/landscape or inverted orientations involves removing and reattaching the hanger wire or bracket from the delivered orientation. Some development easels allow for changing the orientation of a work in progress, however this is based on the easel and not the finished frame. Conventional mechanisms such as those explained above therefore suffer from a variety of deficiencies. One such problem inherent in the conventional devices is that once the creative process has concluded, the rotatable easels can only be used as a temporary display or demonstration tool.

An example may illustrate. Suppose a gallery owner or art buyer wants the option of permanently hanging a painting on the wall and being able to turn it while viewing it? Turning a painting, especially an abstract one, offers many advantages. One advantage is to allow a potential buyer or an owner to witness how, with every turn, the mood and/or meaning of a piece changes. In a sense one has, not a single painting, but several, as each turn presents a different set of relationships (of color/value/shape/texture) to discover and regard. Another advantage is to provide to viewers an insight into the artist's creative process. Art is made by a combination of deliberate acts, but also by an equally important amount of unconscious influence. Often that unconscious influence can only be seen by turning a painting in a different way than it was originally seen. A further advantage is to allow an artist to sell a painting with a rotatable frame attached and give the buyer the option of displaying it any way he or she wishes, without having to attach four wires on the back to facilitate this.

There is currently nothing available to an artist for both creation of art on a rotating device and for conveniently, attractively and economically displaying it in a rotatable way on a wall afterward. Accordingly, configurations herein substantially overcome the above-described shortcomings of conventional display mediums by providing a display apparatus for painted or printed works, such as posters, architectural and 3-dimensional models, including a central hub having a turntable operable for rotation around a base, and a bracket attached to the base and adapted for substantially vertical mounting. A plurality of opposed arms extending radially from the turntable each have an attachment mechanism fixed at a distal end of each of the opposed arms. The opposed arms are attached to the turntable at a proximate end, such that each of the arms has a length adapted to adjust to correspond to a display piece by extending and retracting to fit the dimensions of the piece. The attachment mechanism includes a standoff wing extending from and elongated in a direction toward a plane defined by the base whereby the standoff wing extends toward a horizontal or vertical surface on which the central hub is disposed. The standoff wing therefore maintains the display piece off the wall or display surface on which the base rests. The standoff wing also functions as a handle for rotating the piece without actual user contact as it is adapted to transmit rotational force to the central hub based on the fixed attachment of the arms to the turntable. The rotating frame, or "RoFrame" as disclosed herein can be used both in the creation of the art and, equally importantly, in the displaying of it on the walls of a gallery, business, or family home.

The arms are extendable from a first position to a second position to accommodate differently sized pieces of art. Accordingly, a single rotatable art frame is capable of displaying pieces of art of different sizes. A holding mechanism is disposed on at least one of the arms for securing a piece of art to the arm. The rotatable art frame may further include a handle in mechanical communication with at least one of the arms, such that the handle permits a person to rotate said turntable a desired amount.

In further detail, the display apparatus for painted or printed works includes a central hub having a turntable operable for rotation around a base, and a bracket attached to the base and adapted for substantially vertical or horizontal mounting. A plurality of opposed arms extends radially from the turntable, and an attachment mechanism is fixed at a distal end of each of the opposed arms, such that the opposed arms attach to the turntable at a proximate end, and each of the arms having a length adapted to adjust to correspond to a display piece for support. A standoff wing extends from the attachment mechanism, in which the standoff wing is elongated in a direction toward a plane defined by the base whereby the standoff wing extends toward a horizontal or vertical surface on which the central hub is disposed. The standoff wing adapted to define a handle to transmit rotational force to the central hub based on the fixed attachment of the arms to the turntable.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1A:
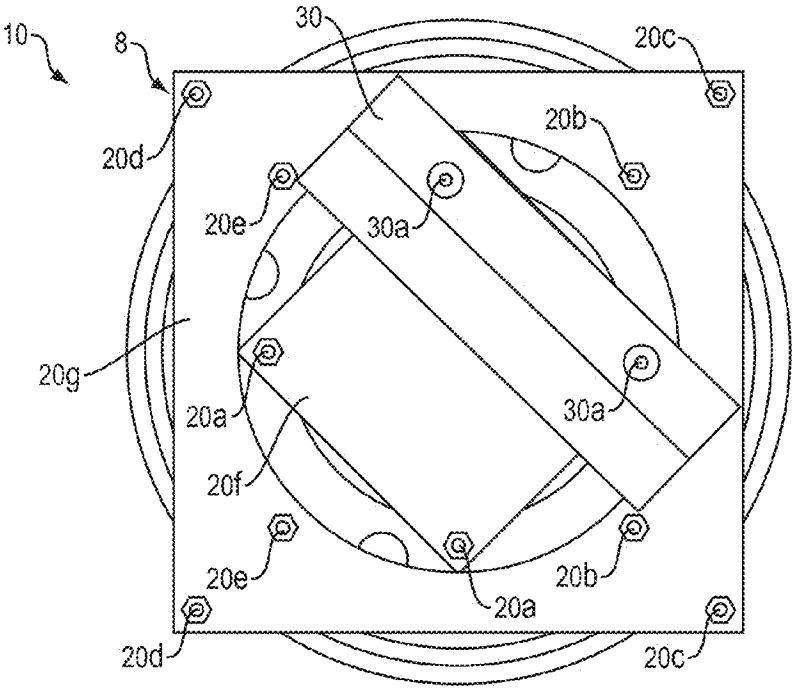
FIG. 1*a* shows a rotatable art frame device in accordance with a particular embodiment of the present invention.
Figure 1B:
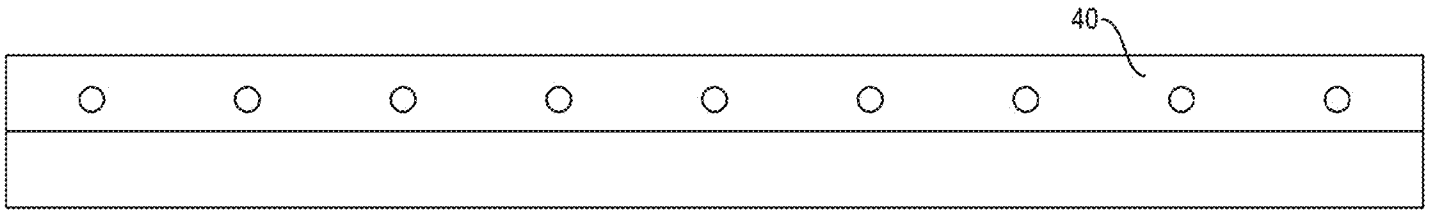
FIG. 1*b* shows a wall mounting bracket operable with the device of FIG. 1*a;*

Configurations discussed below depict various features and advantages of the rotating art frame, which may be referred to as a rotating art frame device, rotating frame, or simply the device. The device is mounted on the stretcher bars of the backside of a canvas, or onto the backside of a frame of a framed artwork, and the assembly is slid easily into a wall-mounted aluminum bracket or plate defining a cleat engagement. When in place, the painting can be easily turned with the side handles so that the canvas or frame is not touched by the viewer.

The configurations set forth below represent the necessary information to enable those skilled in the art to practice the invention. Upon reading the following description in light of the accompanying figures, those skilled in the art will understand the concepts of the invention and recognize applications of these concepts not particularly addressed herein.

Particular configurations of the invention will now be described with reference to the accompanying drawings. The invention may, however, be embodied in many different forms and should not be construed as limited to the embodiment set forth herein; rather, this embodiment is provided so that this disclosure will be thorough and complete, and will fully convey the scope of the invention to those skilled in the art. The terminology used in the detailed description of the particular embodiment illustrated in the accompanying drawings is not intended to be limiting of the invention. In the drawings, like numbers refer to like elements.

The rotatable art frame may be manufactured from off-the-shelf parts, including steel turntables, extruded aluminum channels, bent aluminum plates, aluminum spacers, and aluminum interlocking hangers, a variety of hardware (hex nuts and bolts, PEMs, hex standoffs, flat socket cap screws, socket set screws) and miscellaneous materials (felt pad, rubber tips) to construct two parts: rotaries and arms. Fabrication is therefore unencumbered from specialized machining or part assemblies.

The turntable assemblies, or rotaries, are medium or small in size and can accommodate four arms that are large, medium or small in size to allow an artist to mount the arms on a canvas of any suitable size.

The rotary consists of an off-the-shelf turntable (colloquially referred to as a "lazy susan") specially adapted to hold four arms securely, to hang from an interlocking hanger on a wall or mounting/resting surface, and to rest stably against the wall. Because of the wide size ranges of paintings that can be accommodated, two different configurations of rotaries are disclosed; other sized may be employed. The design of the medium rotary configuration will be detailed first.

Referring to FIGS. 1*a*-7, embodiments of the rotatable art frame are shown. In FIGS. 1*a* and 1*b*, the rotatable art frame 10 is configured as a display apparatus for painted or printed works and includes a turntable 20 and a wall mounting bracket 40 which can be mated with hanger 30 and include hardware 30*a*. The turntable is rotatable within a single plane based on a mounting orientation, typically horizontal or vertical/near vertical. The wall mount is used to secure the apparatus to a flat surface, including but not limited to a wall or a table. FIGS. 2*a*-2*c* show a rotatable art frame 100 having a turntable 110 and associated hardware and a mounting hanger 120 which can be mated with bracket 130.

Referring again to FIG. 1, the disclosed display apparatus for painted or printed works includes a central hub 8 having the turntable 20 and square frame 20G operable for rotation around a base 20F, and the hanger 30 is attached to the base 20F and adapted for substantially vertical or horizontal mounting. Compact, low profile and/or surface mount fasteners may be employed for mitigating forward projection. In an example arrangement, the fasteners may be PEM® threaded studs and nuts. Other suitable fasteners may also be employed. An outer ring of the turntable 20 has four PEM® threaded studs fastened to it for attachment of the square frame 20G. Four aluminum female threaded hex standoffs 20A and 30A maintain wall separation. To two of these 20A may be fixed plastic bumpers for resting against the wall, and to the other two 30A is attached a four-inch section of an interlocking hanger 30.

An inner ring of the turntable has four pair of PEM® threaded studs 20B, 20C, 20D, 20E for attachment of four arms, discussed below. This compact design allows for the turning mechanism mounted on the back of a painting to being only 1.125" proud of the wall.

Figure 2B:
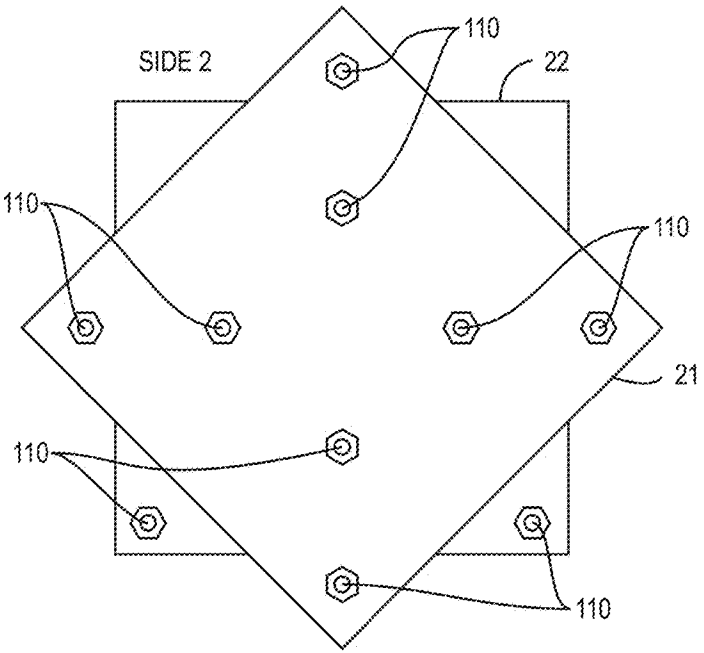
FIGS. 2*a* and 2*b* show a rotatable art frame in accordance with a particular embodiment of the present invention.
Figure 2A:
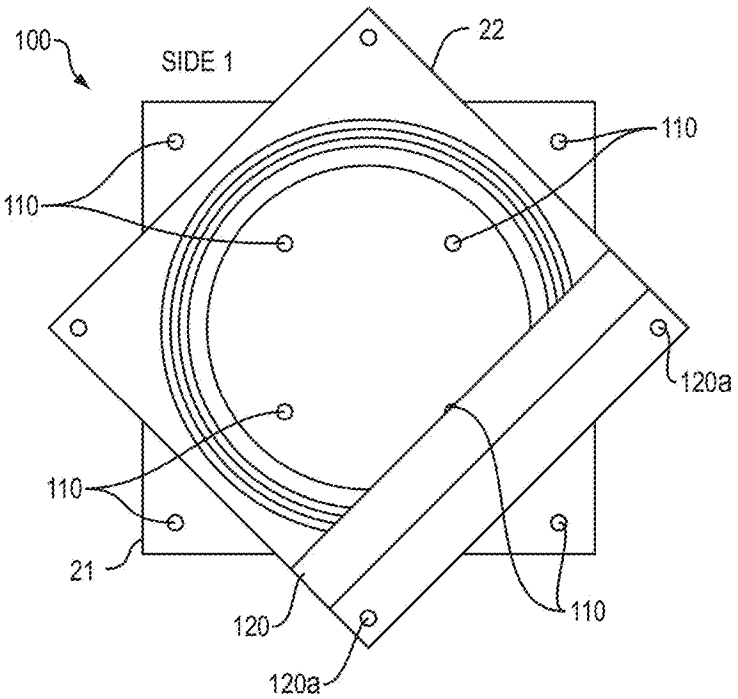
Figure 2C:
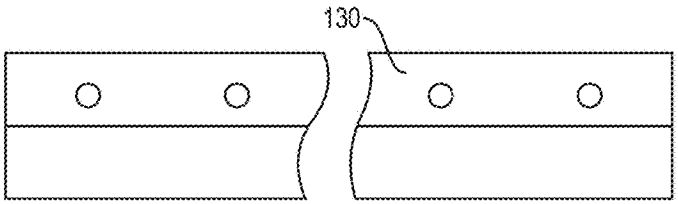
FIG. 2*c* shows a mounting bracket operable with the configuration of FIGS. 2*a* and 2*b*.

FIGS. 2*a*-*c* show a configuration adapted for smaller works having a hub 100 including a square turntable 21 rotatably attached to a base 22. Referring to FIGS. 2*a*-2*c*, the small rotary may employ a 6" square galvanized steel turntable. To one side is attached a 6" piece of interlocking hanger 120, engageable with bracket 130, with two PEM® threaded studs and hex nuts 120A and, to rest against the wall, two plastic self-adhesive bumpers are attached to the opposite edge. To the opposed side of the turntable 21, four pair of (8) PEM® threaded studs 110 are fastened to secure a reinforcing 6"×6"×⅛" think aluminum place, for stable attachment of four arms, discussed further below.

Figure 3A:
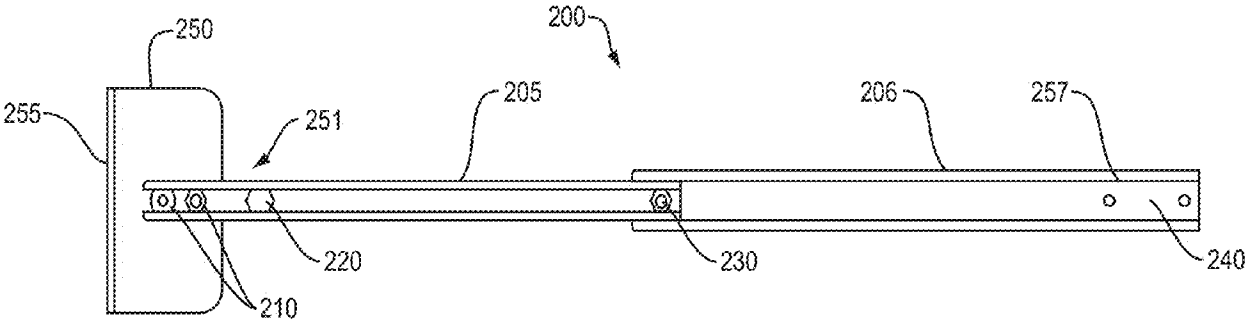
FIGS. 3*a* and 3*b* show a diagram of an extendable arm of a rotatable art frame in accordance with a particular embodiment of the present invention.
Figure 3B:
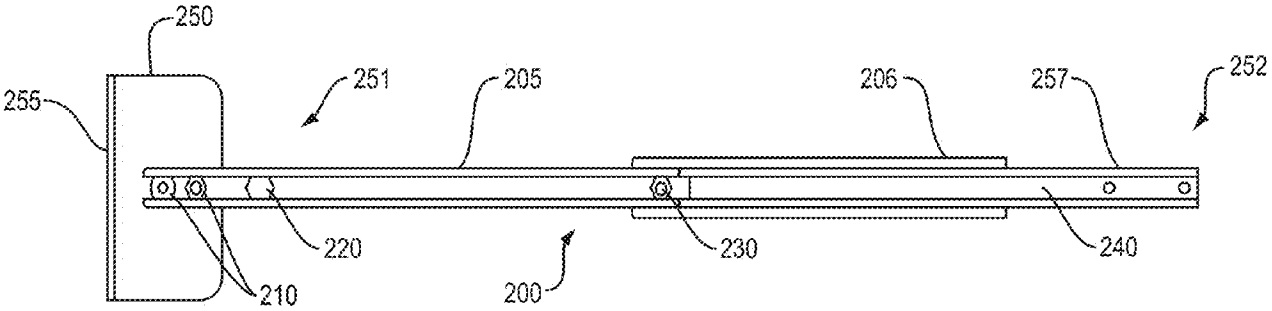

FIGS. 3*a* and 3*b* show a diagram of an extendable arm of a rotatable art frame in accordance with a particular embodiment of the present invention. Referring to FIGS. 1*a*-3*b*, the turntable 20, 21 employs a plurality of opposed arms 200 extending radially from the turntable 20 for attaching to the display piece. A fixation mechanism 230 is adapted to secure a first part 205 and a second part 206 in the overlaid position for securing the length of the arm in a fixed position. Typically two opposed pairs, or four arms 200 are employed, corresponding to 4 sides of a rectangular piece. Compact fasteners may be employed for attaching the first arm part to the turntable for mitigating a projection of the central hub and opposed arms. An attachment mechanism 250 lies flush with the frame of the piece and employs standoff wings 255 extending from the piece to allow movement and for maintaining a standoff from the wall or mounting surface.

The standoff wings 255 appear as "L" shaped brackets at the ends of the arms 220, having a leg parallel to the display piece and a leg perpendicular to the display piece. The perpendicular leg extends towards the wall or mounting surface, and has a length suitable for dual usage as a handle and as a wall standoff, depending on length. The standoff leg may extend less than the distance to the wall, operable only as a secondary bumper in the event that an extreme force attempts to dislodge the hanger 30. The standoff wings 255 therefore may operate in conjunction with a pad 220 to keep the display piece a uniform distance off the wall or display surface on which the base rests. The standoff wings also provide a user interface or handle for rotating the arms 200 without actually touching the display piece. The attachment mechanism 250 is fixed at a distal end 251 of each of the opposed arms 200, such that the opposed arms are attached to the turntable at a proximate end 252, such that each of the arms has a length adapted to adjust to correspond to a display piece. In the example shown, the fixation mechanism 230 includes a threaded member for drawing the first part 205 and the second part 206 into a frictional engagement.

In one particular configuration as shown, the rotary arms 200 are defined by aluminum sliding channels—a primary slide and a mating hold down channel, each of friction-reducing satin anodized aluminum, which permit the two sliding channels to telescope, allowing for a large variety of sizes obtainable with one set of arms. The mating hold down channel has two apertures in its proximal end 252. These allow for the attachment of the arms 200 to the turntable 20 using quarter inch nylon-insulated hex nuts, such that by tightening them to finger tight, some play is allowed in each arm for fitting to a canvas that is slightly out of square and by tightening with a socket, secures each of the arms to the rotary. Each of the arms 200 has a first part 205 and a second part 206, each of the first and second parts adapted to overlay the other for adjusting the length of the arm. The first part 205 defines a primary slide having two holes in the distal end and one in the proximal end. The hole in the proximal end is aligned with a fixation mechanism 230 defined by a quarter inch hex nut with setscrew to be screwed through the hole to the mating hold down channel to maintain the arm at the desired length.

The fixation mechanism 230 is disposed at the overlaid position common to both the first part and the second part. In a particular configuration, the fixation mechanism is disposed at a proximate side of the first part 205 distal from the attachment mechanism. It is expected that a corresponding profile exists in both the first part 205 and second part 206 adapted for slideable communication along an axis defined by the radial extension of the arm 200 for telescoping engagement. Alternate fixation mechanisms may be employed.

Referring to FIG. 3*b*, in the case of the small rotary, the arms are similar to the medium rotary arms except for one modification. Three inches of the proximal sides 257 (closest to the rotary) of the mating hold down channel have been removed to allow closer attachment of the arms 200 to the rotary.

The two holes in the distal end 251 allow for attachment of a spacer and an attachment mechanism 250 having an appearance of an L-bracket, using quarter inch hex nuts and flat socket cap screws. The spacer maintains each arm's evenness with the rotary as the entire mechanism lays flush against the back of the artwork. The L-bracket has two distinct functions: to allow a secure attachment of each rotating frame arm to the art work (canvas stretcher bars, panel, or picture frame) and to provide a handle on each of four sides for the viewer to turn the painting without the need for touching the painting itself, the frame, or the glass. The attachment mechanism 250 lies flush with the frame of the piece and employs standoff wings 255 extending from the piece to allow movement and for maintaining a standoff from the wall or mounting surface.

Between the two distal holes and the one proximal hole, a quarter inch hex nut with a socket cap screw and round adhesive-backed furniture pad 220 can be slid the entire length of the primary slide and fixed in place to provide a padding for each arm that prevents burnishing of the wall as the painting is turned. The pads 220 keep the display off the wall or display surface on which the base rests.

The L-shaped design defines the standoff wing 255 extending from the attachment mechanism 250, such that the standoff wing 255 is elongated in a direction toward a plane defined by the base 20F, 22 (typically the wall or table on which the apparatus is disposed) whereby the standoff wing 255 extends toward a horizontal or vertical surface on which the central hub is disposed. An attachment mechanism lies flush with the frame of the piece and employs standoff wings extending from the piece to allow movement and for maintaining a standoff from the wall or mounting surface. The standoff wing 255 is adapted to transmit rotational force to the central hub based on the fixed attachment of the arms to the turntable. The attachment mechanism 250 is therefore defined by perpendicular facing planes, such that one of the planes is parallel to the arm axis and has apertures adapted to receive fasteners for attachment to a display piece. The perpendicular plane defines the standoff wing 255 and bumper for maintaining a spacing to a surface on which the base mounts, further comprising a moveable spacer on the arm 200, in which the moveable spacer defines a depth corresponding to the bumper.

The hanger 30, 120 provides attachment of the rotating art frame and painting to the wall is afforded by a bracket 40, 130 composed of the same interlocking hanger span that is on the back of the rotary, the two pieces engaging and/or sliding into each other. Features of this wall mounting bracket are holes drilled at 2 inch intervals allowing for mounting on a sheet rock wall with only one of the holes needing to align with a stud, and any other hole being secured to the sheetrock only with a screw of any length. Moreover, the holes in the hanging plate are such that mounting a painting a given distance from floor to center of the artwork is facilitated, as the center of the artwork aligns with the position of the bracket plate holes.

The central hub employs the hanger 30, 120 to engage the bracket 40, 130 defined by a parallel horizontal member on a substantially vertical surface for securing the central hub. The bracket 40, 130 has an angled or indented surface adapted to engage an opposed angled surface on the horizontal member, the angled surface drawing the central hub towards the substantially vertical surface when the central hub is disposed downward. Facilitated by gravity, the artwork can rest in the interlocking hanger and not move as it is turned, or, it can be slid left or right a variable number of inches to center the painting vertically on the wall.

In the case of the small rotary, a particular configuration uses a 6" square galvanized steel turntable. To one side is attached a 6" piece of interlocking hanger (FIG. 2, Side 1, E(a)) with two PEM® threaded studs and hex nuts (FIG. 2, Side 1, A) and, to rest against the wall, two plastic self-adhesive bumpers are attached to the opposite edge. To the other side of the turntable, four pair of (8) PEM® threaded studs are fastened to secure a reinforcing 6"×6"×⅛" think aluminum place, for stable attachment of four arms.

Figure 4:
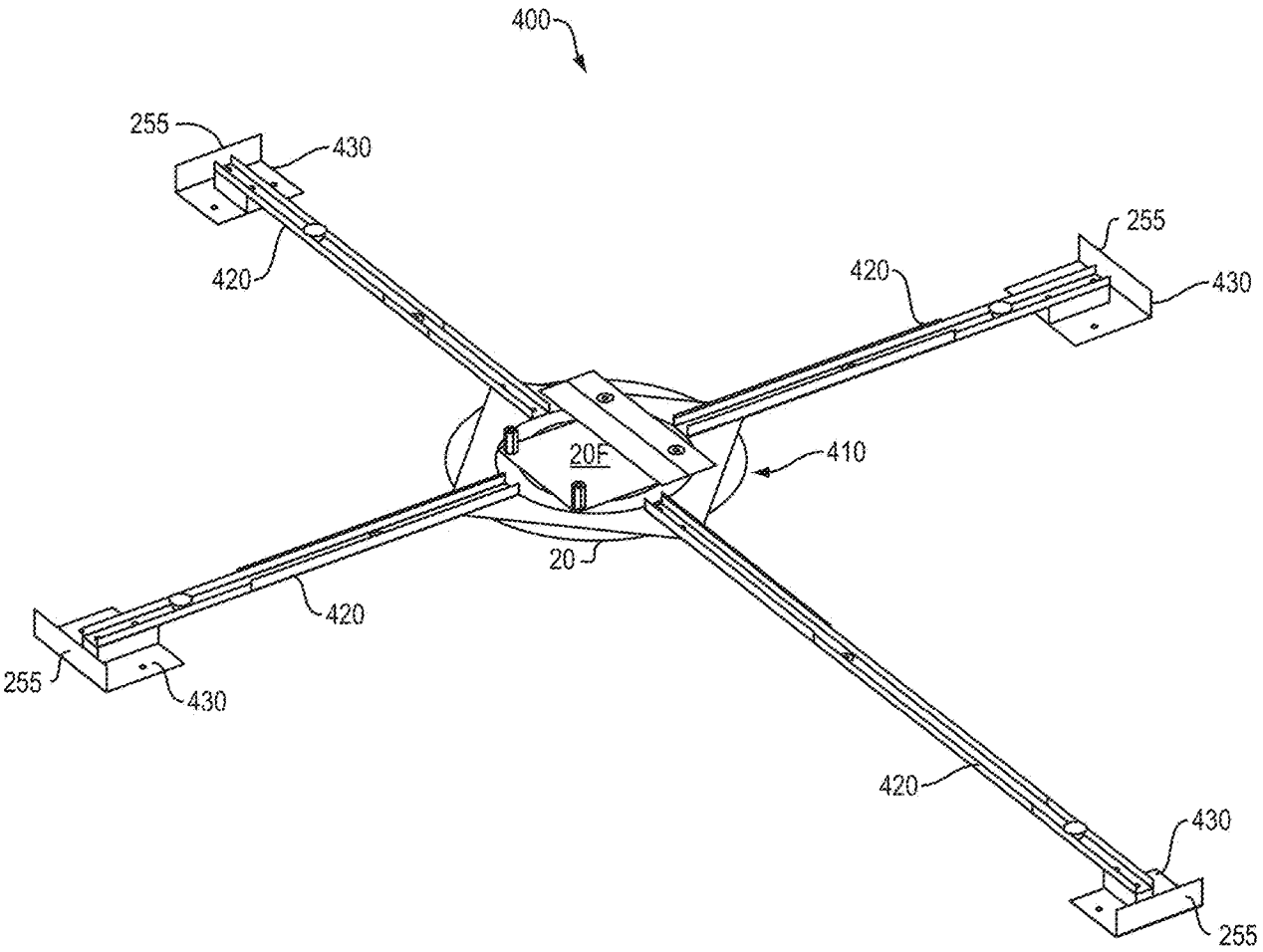
FIG. 4 shows a perspective view of the rotatable art frame including a plurality of extended arms in accordance with a first particular embodiment of the present invention.

FIG. 4 shows the rotatable art frame 400 including a hub having a turntable 410 rotatably mounted to the base 20F, and a plurality of arms 420 extending from turntable 410. The extendable arms 420 include a holding mechanism 430 for securing the piece of art to the rotatable frame 400 employing the medium turntable 20 of FIG. 1.

Figure 5:
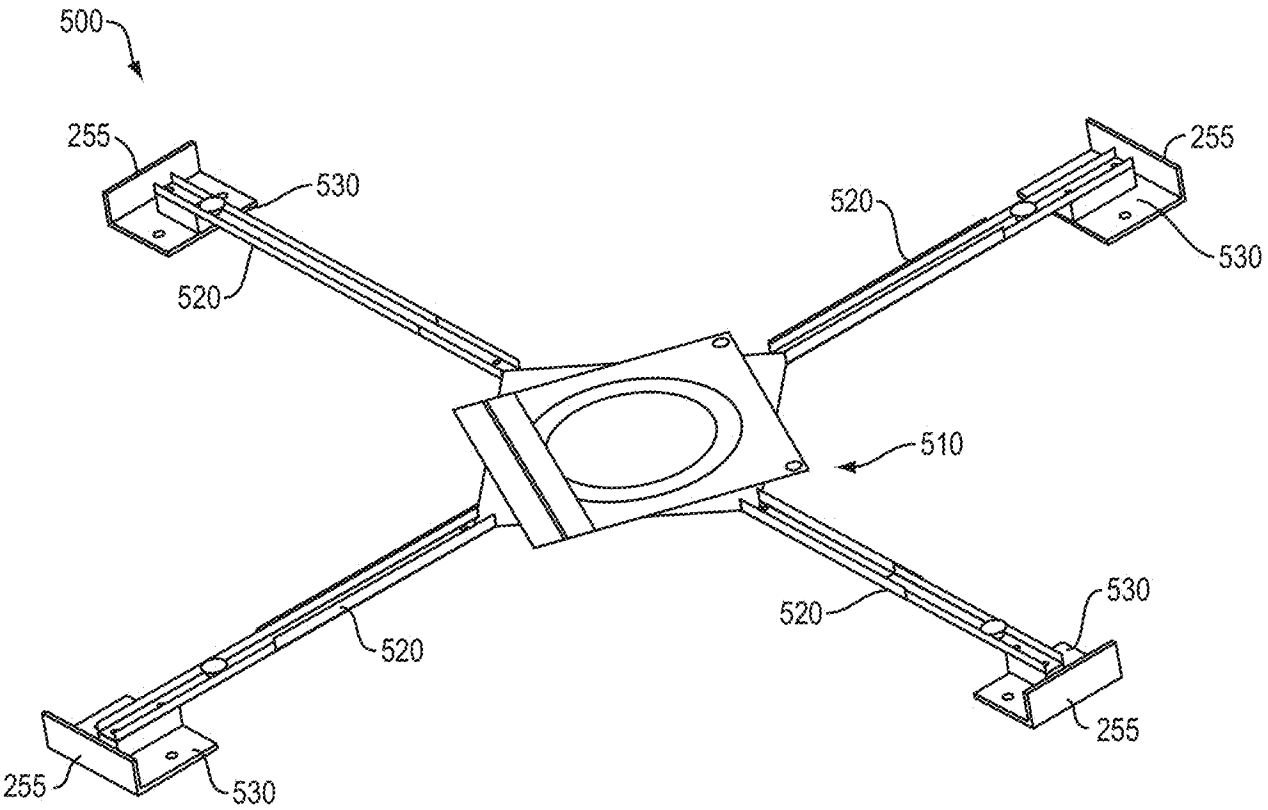
FIG. 5 shows an alternate configuration of the rotatable art frame including a plurality of arms in accordance with a particular embodiment of the present invention.

FIG. 5 shows the rotatable art frame 500 including a turntable 510 and a plurality of arms 520 extending from turntable 510 employing the small rotary (turntable 22 of FIG. 2). The extendable arms 200 include the attachment mechanism 530 with the standoff wings 255 for securing the display piece to the rotatable frame 500.

Figure 6:
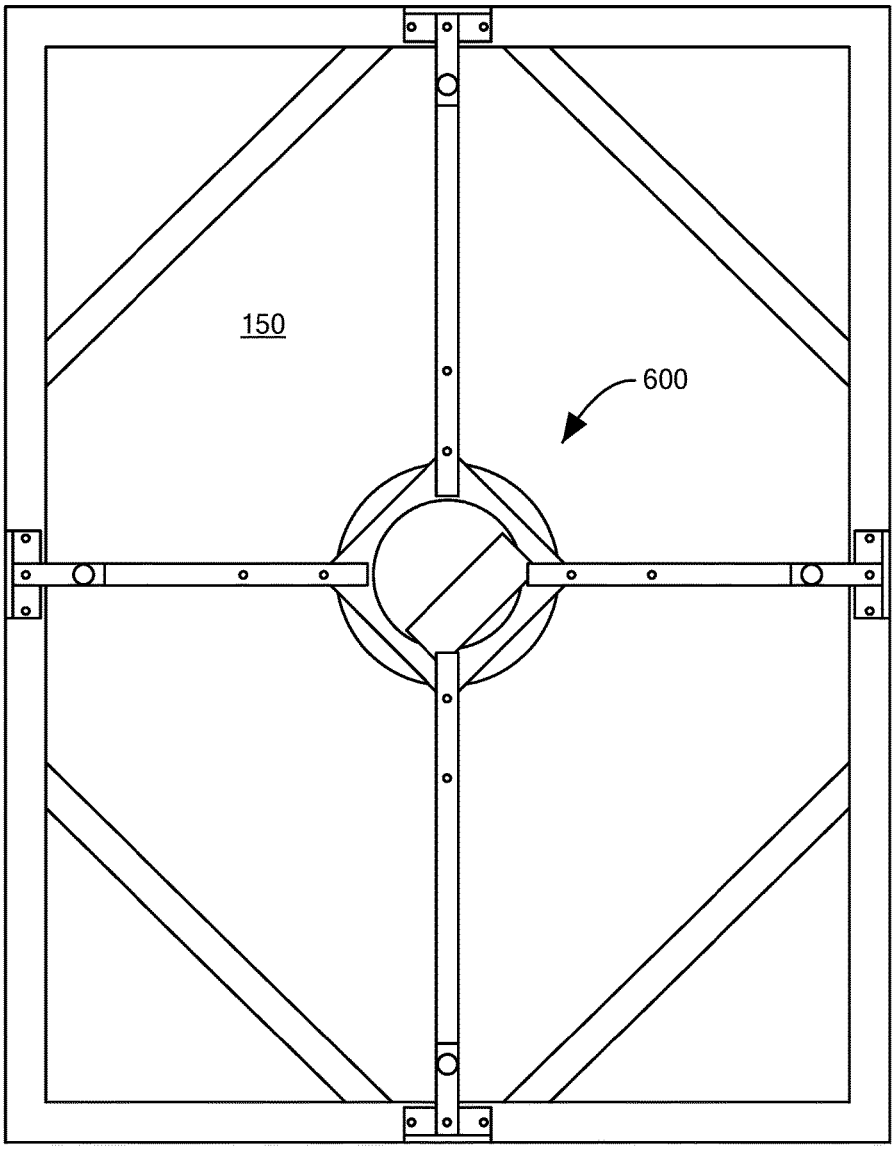
FIG. 6 shows a deployed implementation of the rotatable art frame of FIG. 4 including a plurality of extended arms attached to a piece of art in accordance with a particular embodiment of the present invention.

FIG. 6 shows a rotatable art frame 600 including a plurality of extended arms attached to a display piece 150 in accordance with the embodiment of FIG. 1.

Figure 7:
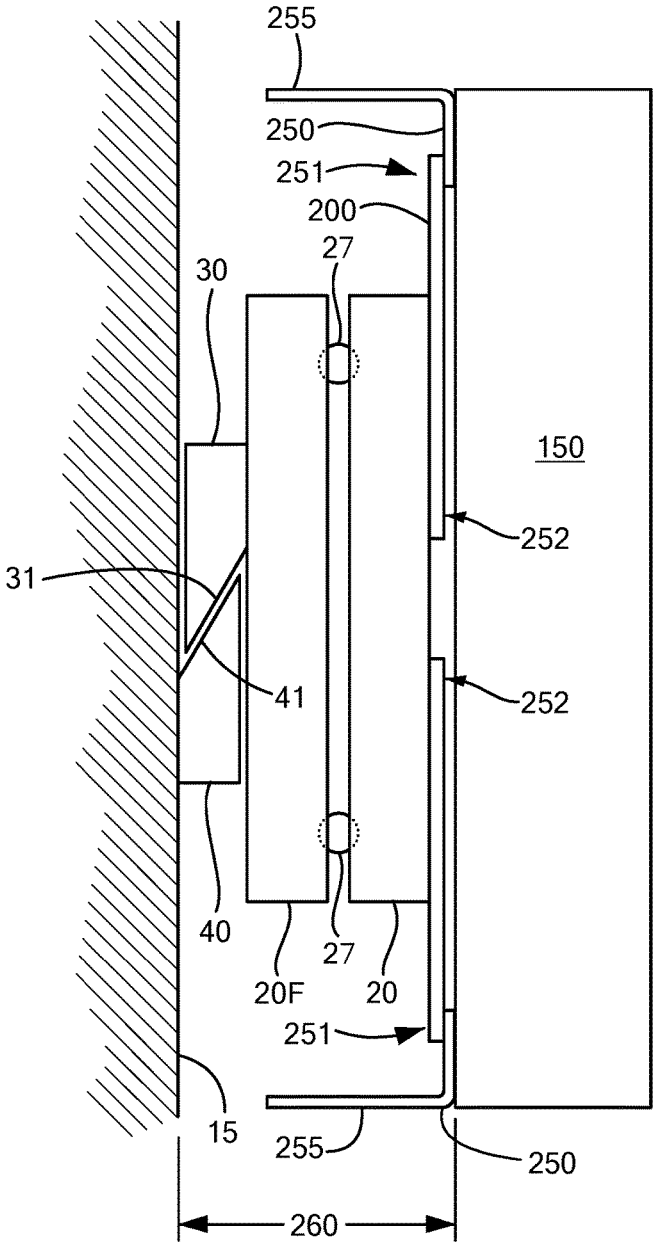
FIG. 7 shows a side view of the art frame of FIG. 6 mounted on a vertical wall surface.

FIG. 7 shows a side view of the deployed apparatus engaging the display piece 150 for illustrating wall standoff. Referring to FIGS. 3*a*, 4 and 7, the bracket 40, secured to the wall 15, is engaged by the hanger 30. Angled cleat surfaces 31 and 41 draw the hanger 30 closer to the wall via gravity. The base 20F rotationally couples to the turntable 20 via ball bearings 27 or other rotational linkage. Arms 200 extend parallel to the wall 15 and employ wings 255 on the attachment mechanism 250 for establishing a uniform depth 260 (figure not drawn to scale).

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A display apparatus for painted or printed works, comprising:

a central hub having a turntable operable for rotation around a base;

a bracket attached to the base and adapted for substantially vertical mounting;

a plurality of opposed arms extending radially from the turntable;

an attachment mechanism fixed at a distal end of each of the opposed arms, the opposed arms attached to the turntable at a proximate end, each of the arms having a length adapted to adjust to correspond to a display piece; and a standoff wing extending from the attachment mechanism, the standoff wing elongated in a direction toward a plane defined by the base whereby the standoff wing extends toward a horizontal or vertical surface on which the central hub is disposed; the standoff wing defining a handle fixed to the attachment mechanism for rotating the central hub based on the attachment of the opposed arms to the turntable.

2. The apparatus of claim 1 wherein each of the arms has a first part and a second part, each of the first and second parts adapted to overlay the other for adjusting the length of the arm.

3. The apparatus of claim 2 further comprising a fixation mechanism adapted to secure the first part and the second part in the overlaid position for securing the length of the arm in a fixed position.

4. The apparatus of claim 3 wherein the fixation mechanism includes a threaded member for drawing the first part and the second part into a frictional engagement.

5. The apparatus of claim 4 wherein the fixation mechanism is disposed at the overlaid position common to both the first part and the second part.

6. The apparatus of claim 4 wherein the fixation mechanism is disposed at a proximate side of the first part distal from the attachment mechanism.

7. The apparatus of claim 3 further comprising fasteners attaching the first arm part to the turntable for mitigating a projection of the central hub and opposed arms.

8. The apparatus of claim 2 further comprising a corresponding profile in both the first part and second part adapted for slideable communication along an axis defined by the radial extension of the arm for telescoping engagement.

9. The apparatus of claim 2 further comprising apertures on the attachment mechanism, the apertures configured to receive fasteners for attachment to a display piece and adapted to correspond to outer edges of the display piece based on the varied length of the opposed arms.

10. The apparatus of claim 9 wherein the attachment mechanism is defined by perpendicular facing planes, one of the planes parallel to the arm axis and having apertures adapted to receive fasteners for attachment to a display piece, and the perpendicular plane defining the standoff wing bumper for maintaining a spacing to a surface on which the base mounts, further comprising a moveable spacer on the arm, the moveable spacer defining a depth corresponding to the bumper.

11. The apparatus of claim 1 wherein the bracket is adapted to engage a parallel horizontal member on a substantially vertical surface for securing the central hub.

12. The apparatus of claim 11 wherein the bracket has an angled surface adapted to engage an opposed angled surface on the horizontal member, the angled surface drawing the central hub towards the substantially vertical surface when the central hub is disposed downward.

* * * * *